US007012575B2

(12) United States Patent
Kim et al.

(10) Patent No.: US 7,012,575 B2
(45) Date of Patent: Mar. 14, 2006

(54) DECELERATION MODULE INTEGRATED WITH ROLLING DEVICE FOR AUTOMATICALLY EXTENDING/RETRACTING ANTENNA AND AUTOMATIC ANTENNA EXTENDING SYSTEM USING THE SAME

(75) Inventors: Ki-Hyun Kim, Suwon-shi (KR); Hyun-Myung Song, Seoul (KR); Sang-Joon Park, Seoul (KR)

(73) Assignee: Samsung Electronics Co., Ltd., (KR)

( * ) Notice: Subject to any disclaimer, the term of this patent is extended or adjusted under 35 U.S.C. 154(b) by 542 days.

(21) Appl. No.: 10/202,733

(22) Filed: Jul. 25, 2002

(65) Prior Publication Data

US 2003/0022705 A1 Jan. 30, 2003

(30) Foreign Application Priority Data

Jul. 27, 2001 (KR) ..... 2001-45325
Aug. 25, 2001 (KR) ..... 2001-51550

(51) Int. Cl.
*H01Q 1/10* (2006.01)
*H01Q 1/24* (2006.01)

(52) U.S. Cl. ..... 343/901; 343/702

(58) Field of Classification Search ..... 343/702, 343/900, 901
See application file for complete search history.

(56) References Cited

U.S. PATENT DOCUMENTS 4,875,053 A * 10/1989 Harada ..... 343/903
6,191,742 B1 * 2/2001 Ha et al. ..... 343/702
6,195,050 B1 * 2/2001 Kim ..... 343/700 MS
6,239,754 B1 * 5/2001 Kim ..... 343/702
6,337,671 B1 * 1/2002 Lee ..... 343/901
6,429,817 B1 * 8/2002 Creigh et al. ..... 343/702

* cited by examiner

*Primary Examiner*—Hoang V. Nguyen
*Assistant Examiner*—Angela M Lie
(74) *Attorney, Agent, or Firm*—Dilworth & Barrese, LLP

(57) ABSTRACT

A deceleration module for extending or retracting a whip antenna. In the deceleration module, a motor unit is installed on the bottom of a body housing, a deceleration unit reduces a rotating force provided coaxially from the motor unit at least twice. A roller unit is integrally formed coaxially with the deceleration module by injection molding, and disposed to roll in an extending and retracting direction of the whip antenna in contact with the outer circumference of the whip antenna.

28 Claims, 18 Drawing Sheets

DECELERATION MODULE INTEGRATED WITH ROLLING DEVICE FOR AUTOMATICALLY EXTENDING/RETRACTING ANTENNA AND AUTOMATIC ANTENNA EXTENDING SYSTEM USING THE SAME

PRIORITY

This application claims priority to an application entitled "Deceleration Module Integrated with Rolling Device, for Automatically Extending/Retracting Antenna and Automatic Antenna Extending System Using the Same" filed in the Korean Industrial Property Office on Jul. 27, 2001 and assigned Serial No. 2001-45325, and to an application entitled "Deceleration Module Integrated with Rolling Device, for Automatically Extending/Retracting Antenna and Automatic Antenna Extending System Using the Same" filed in the Korean Industrial Property Office on Aug. 25, 2001 and assigned Serial No. 2001-51550, the contents of both of which are hereby incorporated by reference.

BACKGROUND OF THE INVENTION

1. Field of the Invention

The present invention relates generally to an antenna device for a portable terminal, and in particular, to a deceleration module integrated with a rolling device, providing force to automatically extend and retract a whip antenna, and to reduce the rotating speed of a driving motor, and an automatic antenna extending system using the deceleration module.

2. Description of the Related Art

In general, a cellular phone is a portable terminal capable of wirelessly communicating with another party via wireless communication or via a base station. Such a portable terminal is typically equipped with an antenna device that converts RF (Radio Frequency) energy received from a transmitter to electromagnetic energy and radiates it in the air, and absorbs electromagnetic energy received from the air and feeds the electric power to a receiver.

The antenna device usually includes a rod-type whip antenna and a helical antenna, wherein the rod-type whip antenna is extended/retracted from/into a body housing. However, the motion of extending or retracting the rod-type whip antenna to increase reception sensitivity can be quite bothersome. Accordingly, automatic antenna extending systems have been proposed in which a whip antenna is automatically extended/retracted from/into a body housing.

Such automatic antenna extending systems are disclosed in Korea Patent Application No. 1998-24444 filed on Jun. 26, 1998 and Korea Patent Application No. 1998-26766 filed on Jul. 3, 1999. These antenna systems have the distinctive shortcomings of the whip antenna extending/retracting mechanism occupying too much area in a body housing, which is against the trend of miniaturization of terminals. Moreover, the requirement of too many parts reduces assembly efficiency and throughput and increases manufacture cost.

SUMMARY OF THE INVENTION

It is therefore an object of the present invention to provide a deceleration module for automatically extending/retracting an antenna, which occupies a minimum area in a body housing and thus contributes to miniaturization of a terminal.

It is another object of the present invention to provide a deceleration module for automatically extending/retracting an antenna, which is realized with a reduced number of parts and thus increases assembly efficiency and throughput.

It is a further object of the present invention to provide a deceleration module having a deceleration unit integrated with a roller unit for automatically extending/retracting an antenna.

It is still another object of the present invention to provide an automatic antenna extending system using a deceleration module for automatically extending/retracting an antenna.

To achieve the above and other objects, there is provided a deceleration module for extending or retracting a whip antenna. In the deceleration module, a motor unit is installed on the bottom of a body housing, a deceleration unit reduces a rotating speed provided coaxially from the motor unit at least twice. A roller unit is integrally formed coaxially with the deceleration module by injection molding, and positioned in a manner that allows its gears to rotate in an extending and retracting direction of the whip antenna, in contact with the outer circumference of the whip antenna.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENTS

Preferred embodiments of the present invention are described below with reference to the accompanying drawings. In the following description, well-known functions or constructions are not described in detail to avoid obscuring the invention with unnecessary detail.

Figure 1:
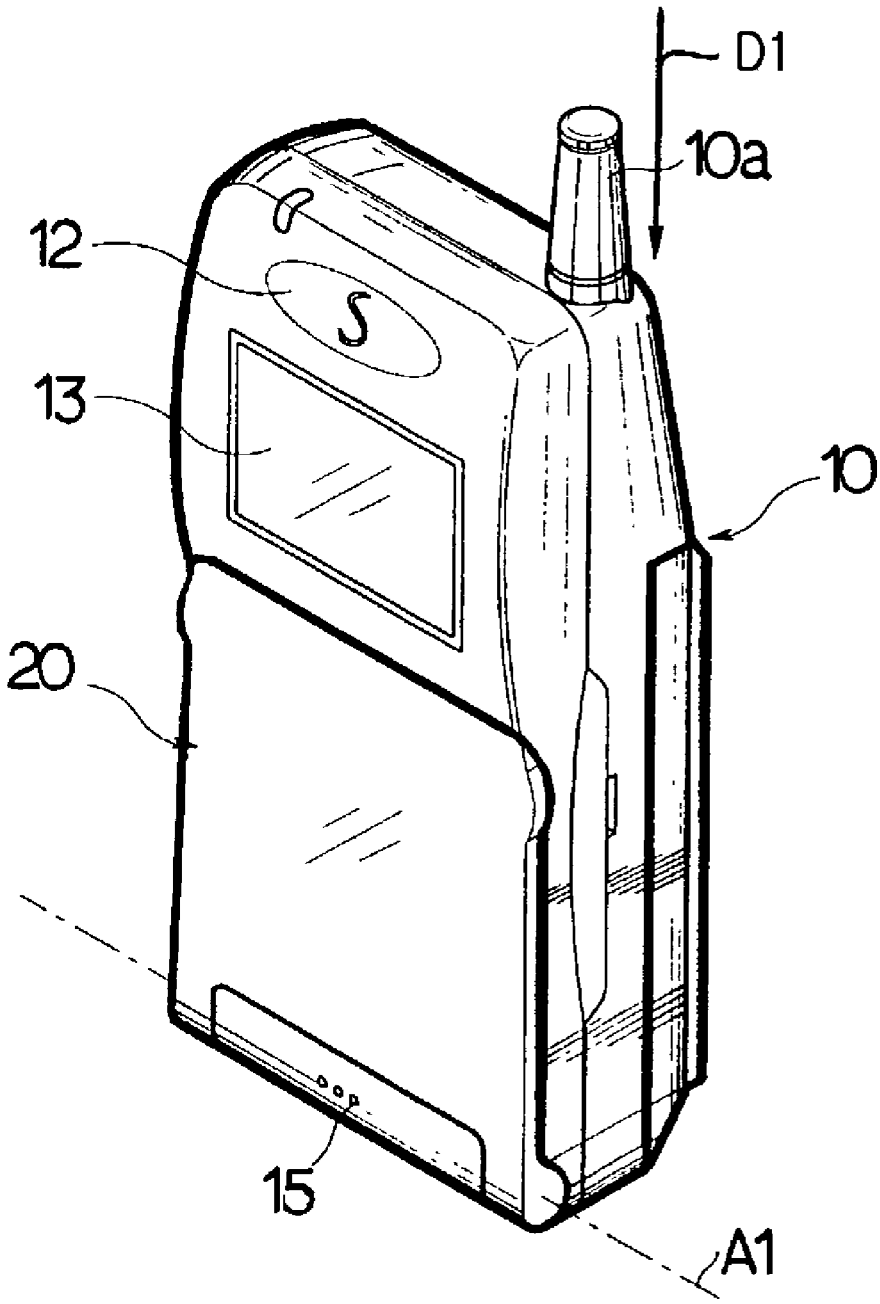
FIG. 1 is a perspective view of a portable terminal with a whip antenna retracted therein, within which an automatic antenna extending system according to the present invention can be mounted.
Figure 2:
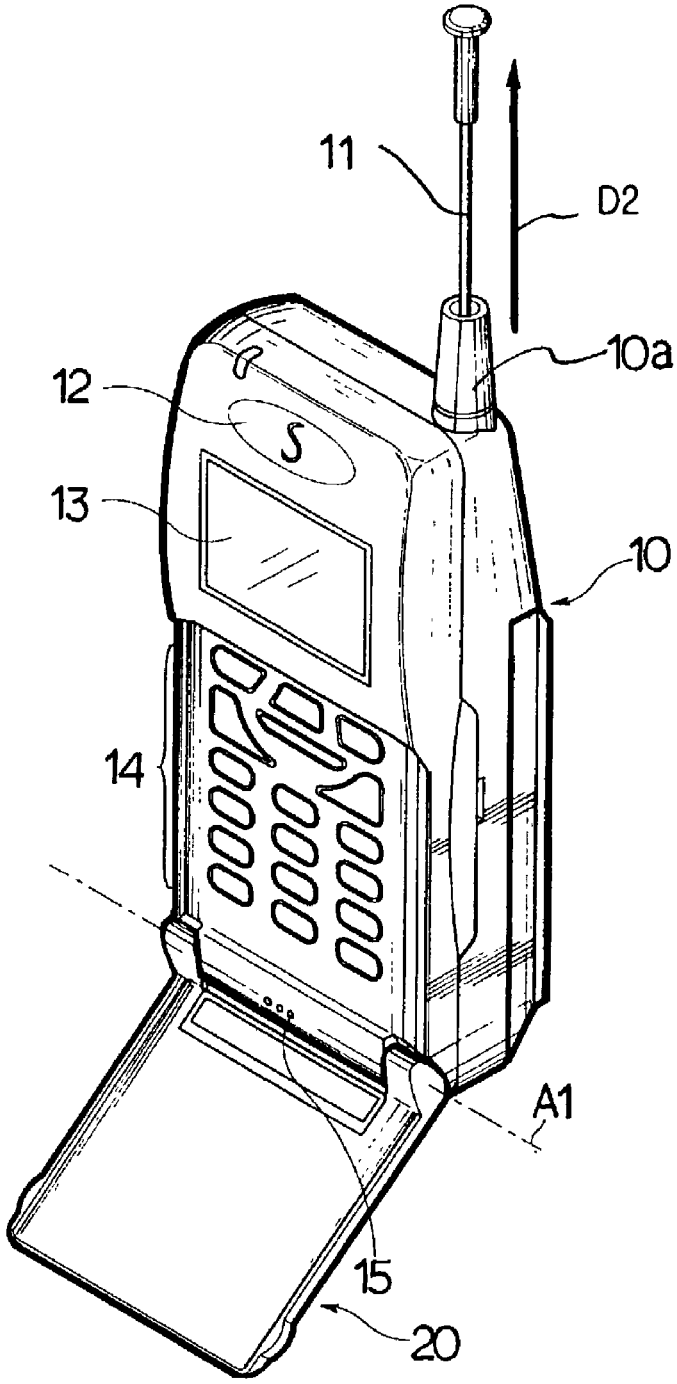
FIG. 2 is a front elevation perspective view of the portable terminal with the whip antenna extended therefrom.
Figure 3:
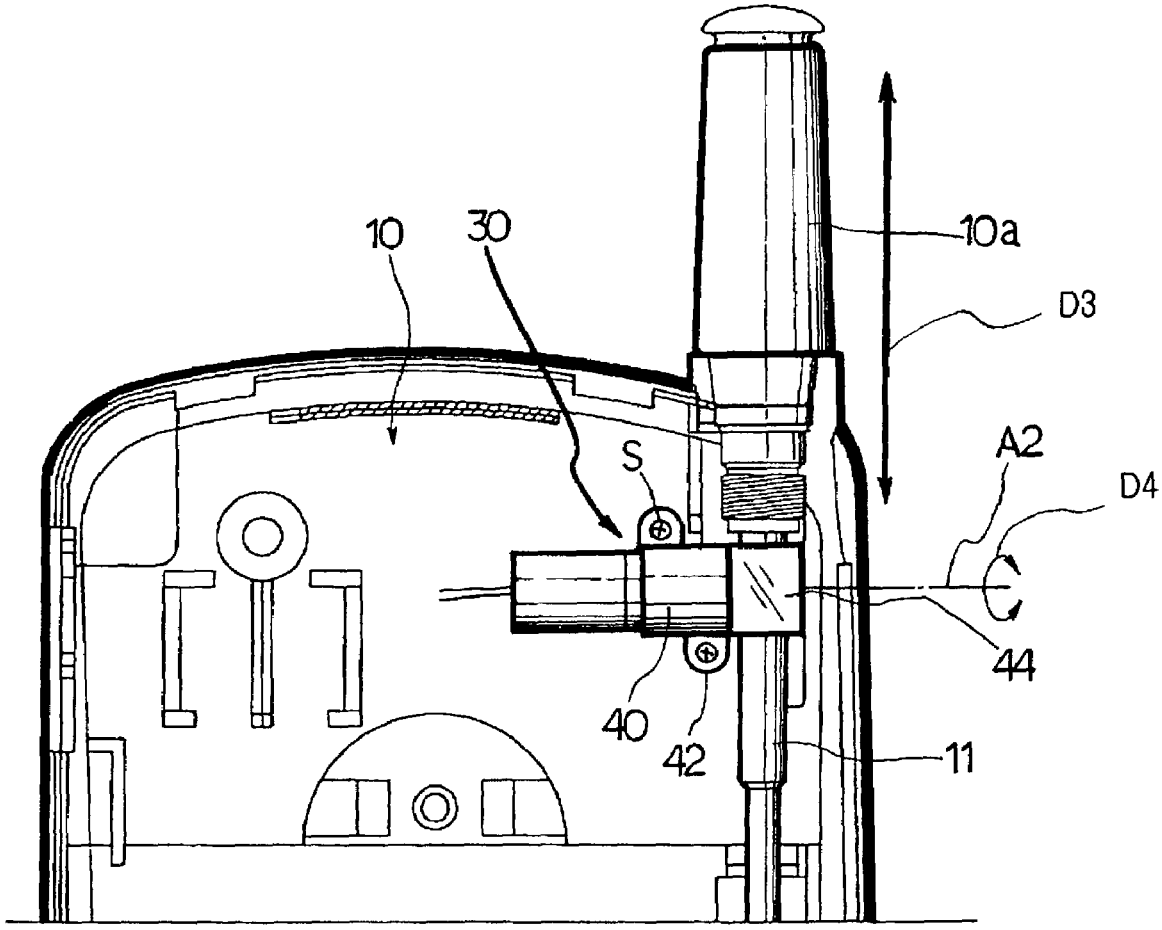
FIG. 3 is a partial cutaway plan view of the portable terminal with a deceleration module contained in a body housing for automatically extending/retracting the whip antenna according to an embodiment of the present invention.

Referring to FIGS. 1, 2 and 3, a portable terminal, specifically a flip-type terminal includes a body housing 10, a flip 20 and a hinge device (not shown) for rotatably connecting the flip 20 to the body housing 10. There are an antenna device (only a whip antenna 11 is illustrated), an earpiece 12, an LCD (Liquid Crystal Display) 13, a keypad 14, and a microphone 15 in the body housing 10. The flip 20 opens on a hinge axis A1 to a predetermined angle with respect to the body housing 10.

A deceleration module 30 for automatically extending/retracting the whip antenna 11 is used in a portable terminal employing the antenna device with the whip antenna 11. The portable terminal is not limited to a flip type.

When a call is terminated and the flip 20 is closed to the body housing 10, the whip antenna 11 retracts into the body housing 10 in a direction D1 (shown in FIG. 1). If the flip 20 is set to an open state from the body housing 10 for a call, the whip antenna 11 extends from the body housing 10 in a direction D2 (shown in FIG. 2). If a button dedicated to initiate or terminate a call (not shown) is selected, the whip antenna 11 will extend or retract, regardless of whether the flip 20 is opened or closed.

The deceleration module 30 is located near the whip antenna 11, and is preferably located under an antenna housing 10*a*, to most effectively provide extending/retracting force to the whip antenna 11 in the portable terminal.

Figure 4:
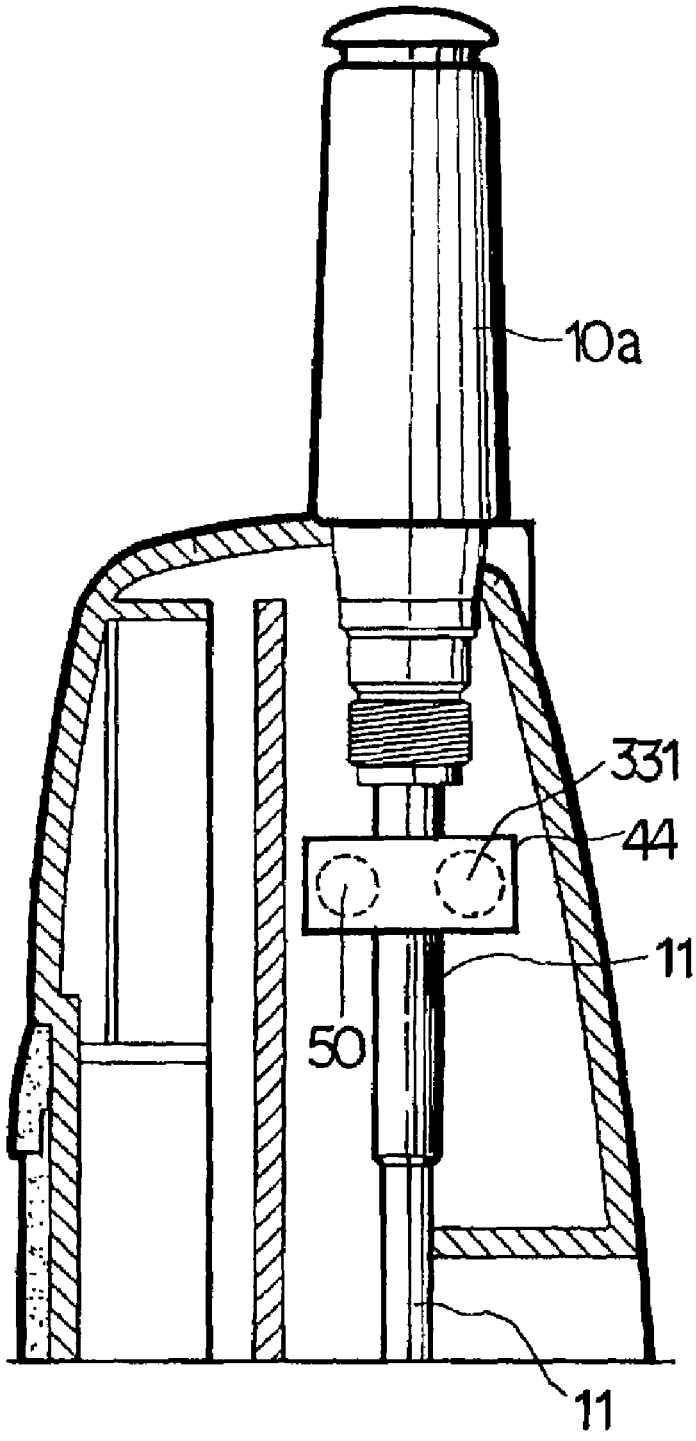
FIG. 4 is a side view of the portable terminal cutaway to show the deceleration module illustrated in FIG. 3.
Figure 5:
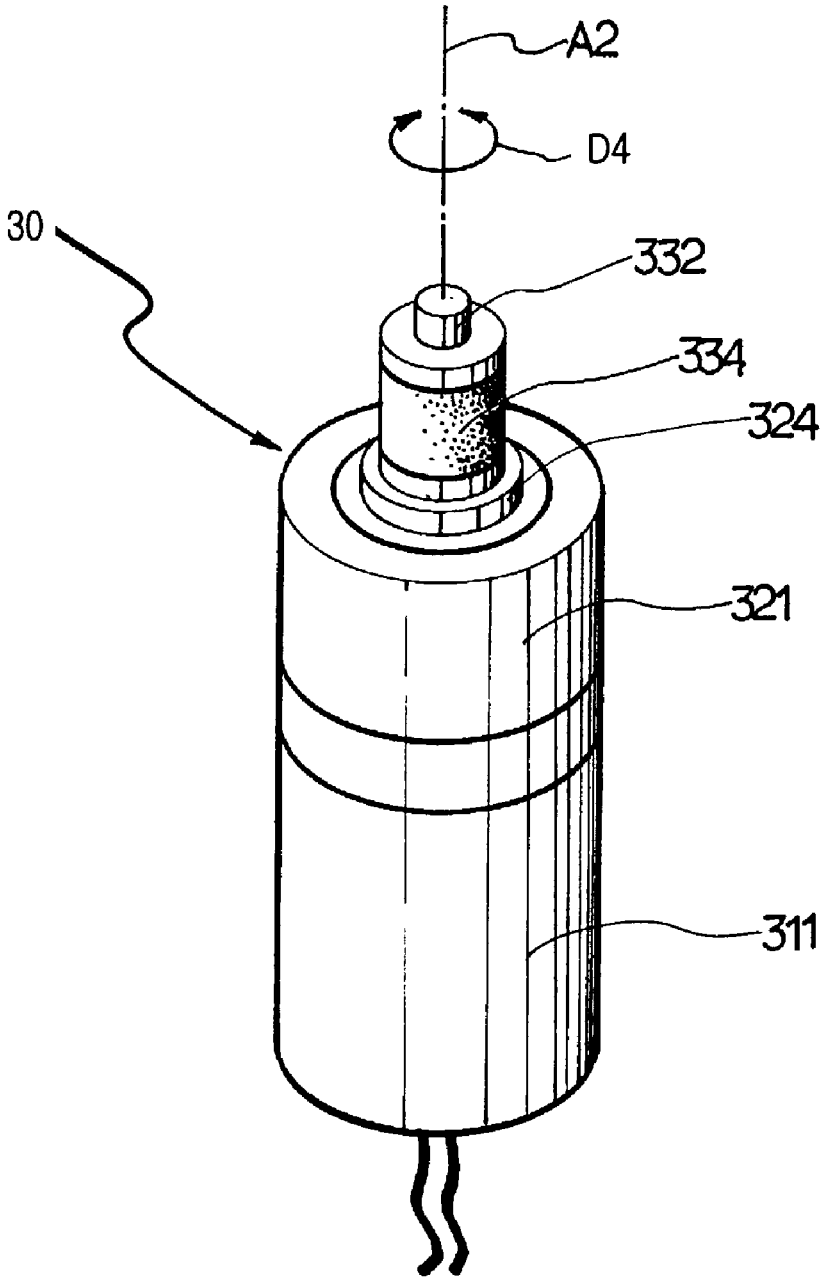
FIG. 5 is an enlarged perspective view of the deceleration module according to an embodiment of the present invention.
Figure 6:
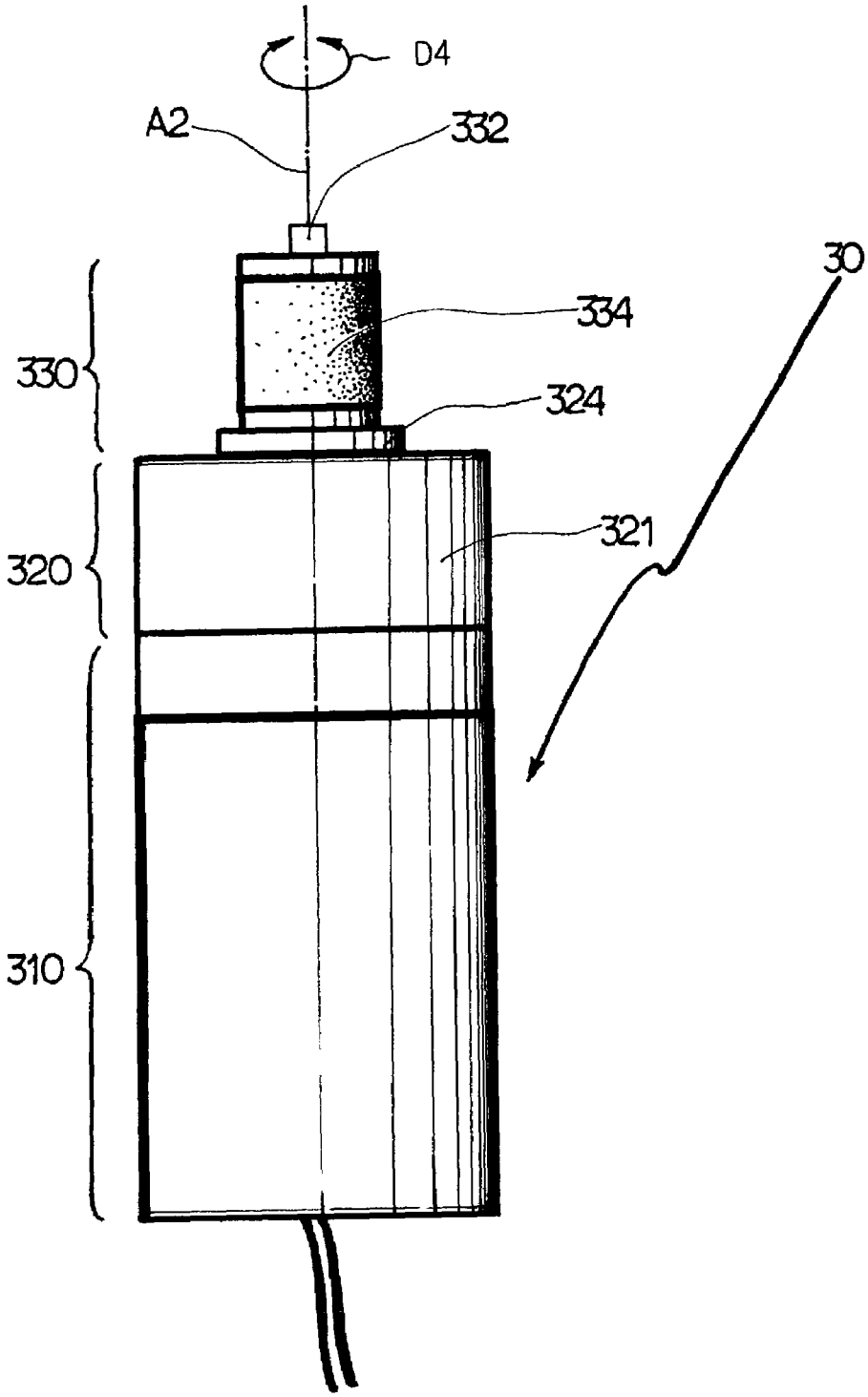
FIG. 6 is a side view of the deceleration module illustrated in FIG. 5.
Figure 7:
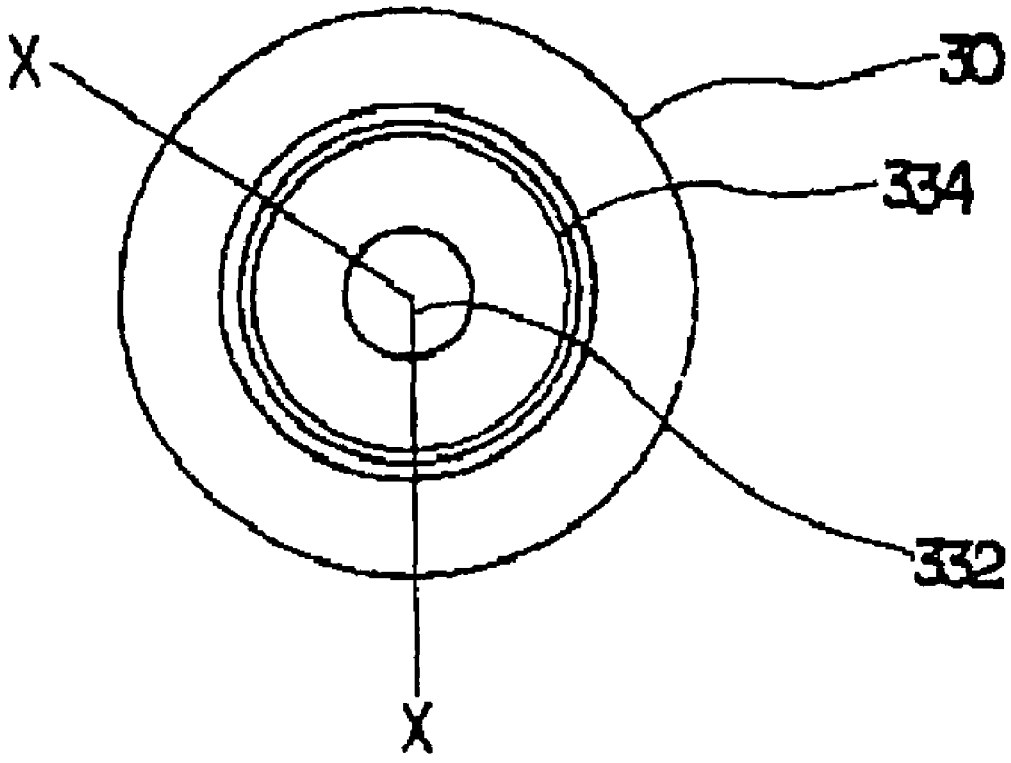
FIG. 7 is a plan view of the deceleration module illustrated in FIG. 5.

The deceleration module 30 is inserted into a bracket 40, which is shown in FIG. 3 as installed on the bottom surface of the body housing 10 by tightening screws (one of which is designated as "S" in FIG. 3) in engaging portions 42 of the bracket 40. The deceleration module 30 is also combined with an auxiliary roller 50 and a plate spring 44 as illustrated in FIG. 4. Since the deceleration module 30 is preferably located under the antenna housing 10*a*, the whip antenna 11 moves in either direction indicated by D3 (as shown in FIG. 3). A roller (not shown) in the deceleration module 30 rotates upon a rotating axis A2 in either direction indicated by D4.

The structure of the deceleration module 30 according to an embodiment of the present invention will be described in detail referring to FIGS. 5 to 9.

Referring to FIGS. 5 to 9, the deceleration module 30 is comprised of a motor unit 310, a deceleration unit 320, and a roller unit 330 integrated with the deceleration unit 320.

The motor unit 310 includes a rotary motor 311. The deceleration unit 320 includes a center gear 312 mounted to the motor unit 310, one or more planetary gears 322, 323 and 324 in engagement with the center gear 312, and an internal gear 325 in engagement with the planetary gears 322, 323 and 324. The deceleration unit 320 reduces a rotating speed offered by the motor unit 310 by at least a factor of two, and provides the reduced rotating speed to the roller unit 330. The deceleration unit 320 is protected by a case 321. Reference characters A3 and A4 denote the rotating axes of the planetary gears 322 and 323.

The roller unit 330 is formed integrally with the deceleration unit 320 as stated before. For example, the internal gear 325 and the roller unit 330 may be integrated by injection molding, ensuring that a shaft portion 324 connects the internal gear 325 to the roller unit 330. The roller unit 330 extends co-axially, with its internal gear 325, from the case 321 and has a hinge shaft 332 formed on its end. A rubber surface coating 334 preferably surrounds a roller 331 in the roller unit 330 to maximize the force of friction between the roller unit 330 and the whip antenna. It is preferable to shape the roller 331 like a spool to maximize the area the whip antenna contacts the roller unit 330.

When the whip antenna is extended/retracted in contact with the rubber surface coating 334, some pressure is produced from the interface between the rubber surface coating 334 and the whip antenna and absorbed in a groove 333 formed on the outer circumferential surface of the roller 331. As a result, the whip antenna comes into contact with the rubber surface coating 334 over a maximum area.

Figure 8:
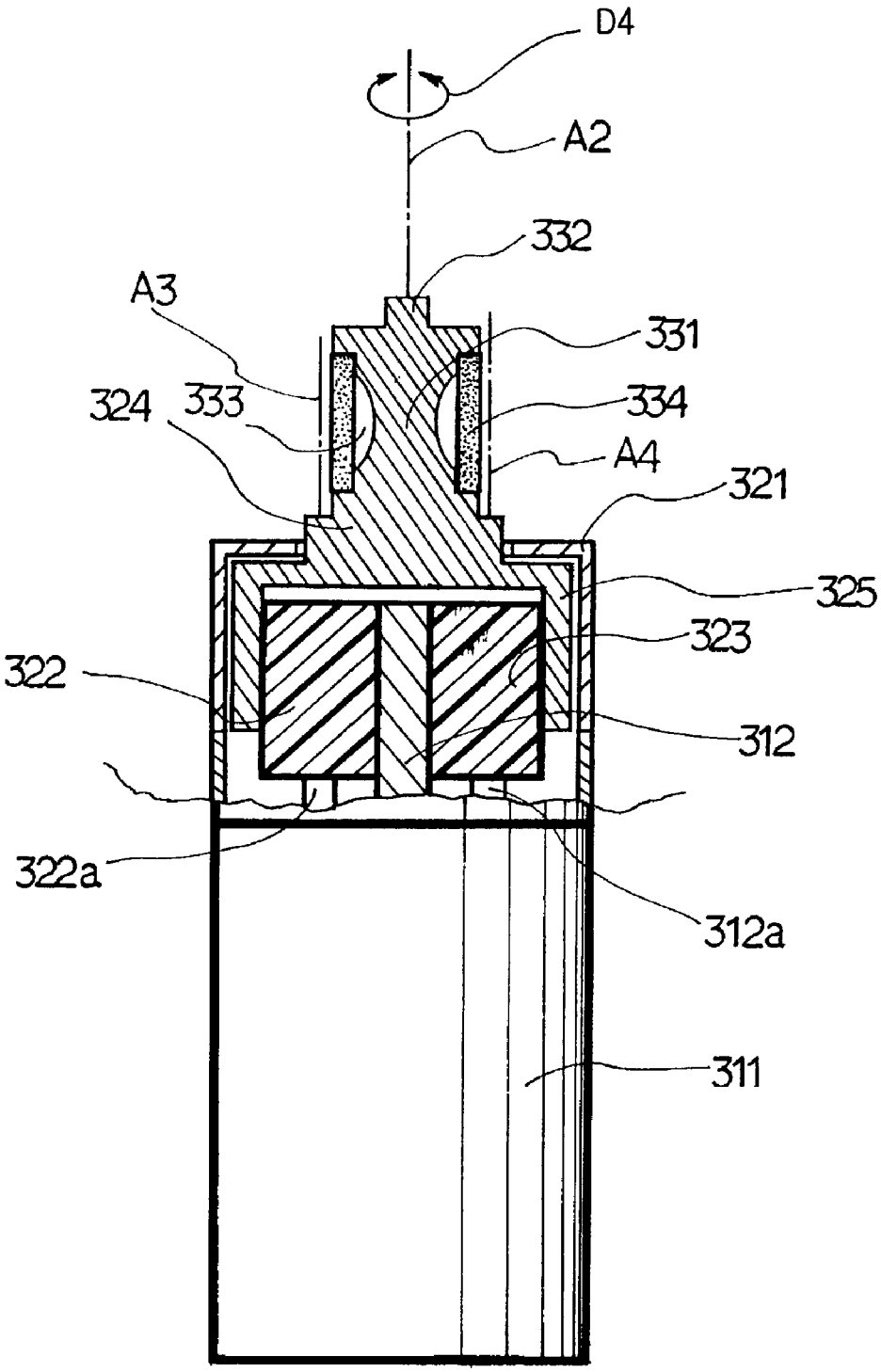
FIG. 8 is a view of the deceleration module according to the embodiment of the present invention, cutaway along line X—X shown in FIG. 7.
Figure 9:
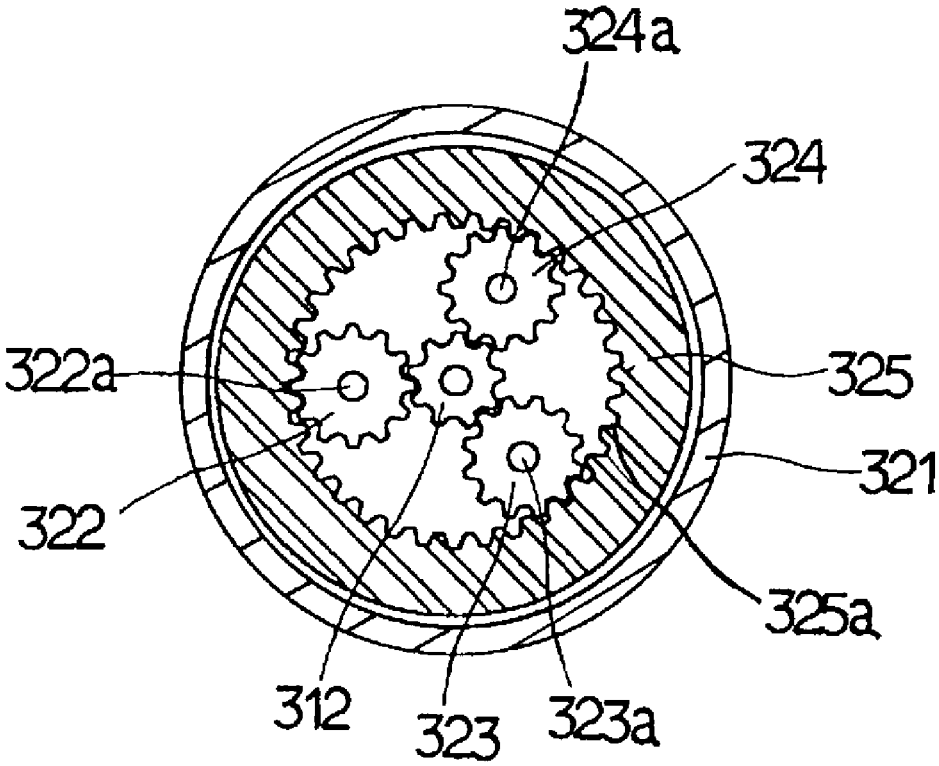
FIG. 9 is a cutaway plan view showing the gears of the deceleration module illustrated in FIG. 5.
Figure 10:
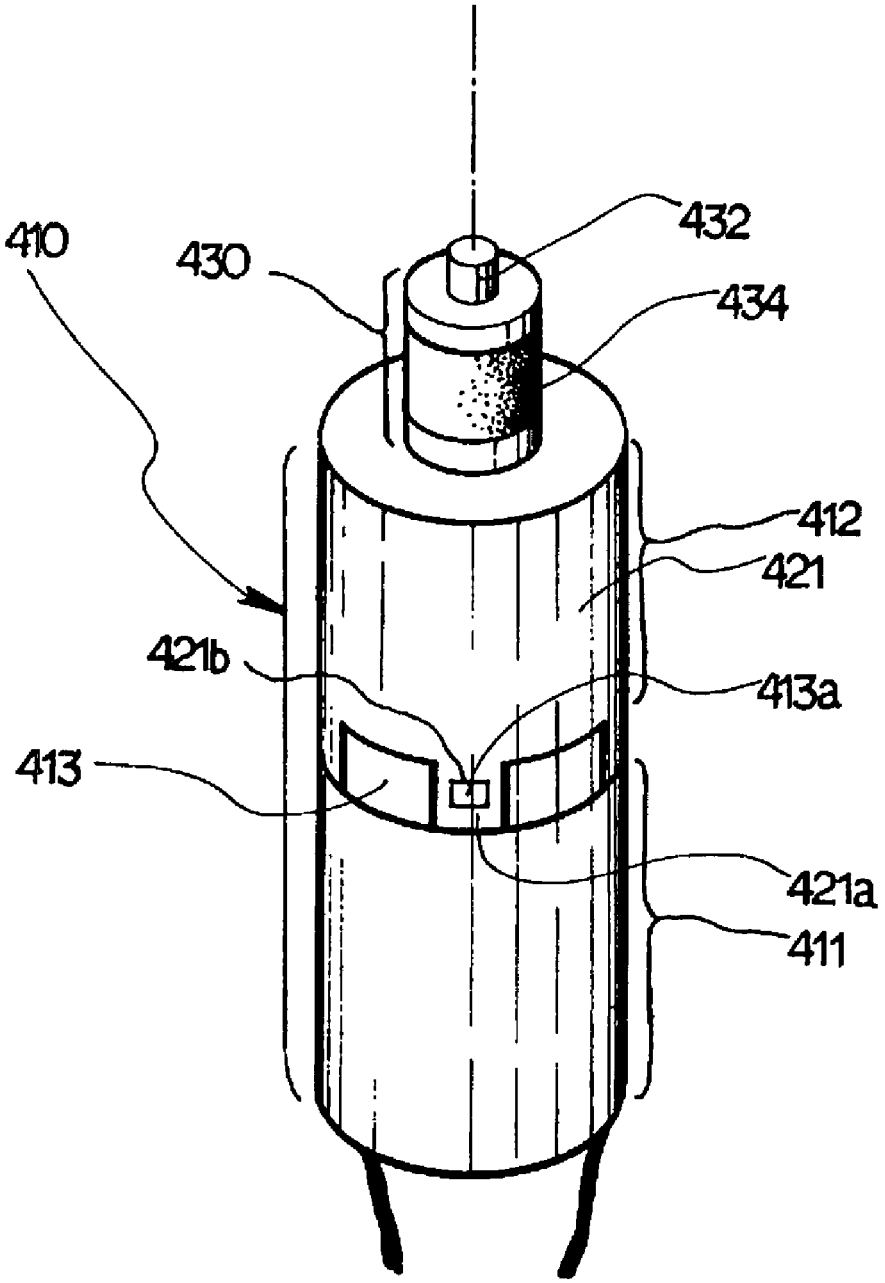
FIG. 10 is an enlarged perspective view of a deceleration module integrated with a rolling device according to a second embodiment of the present invention.
Figure 11:
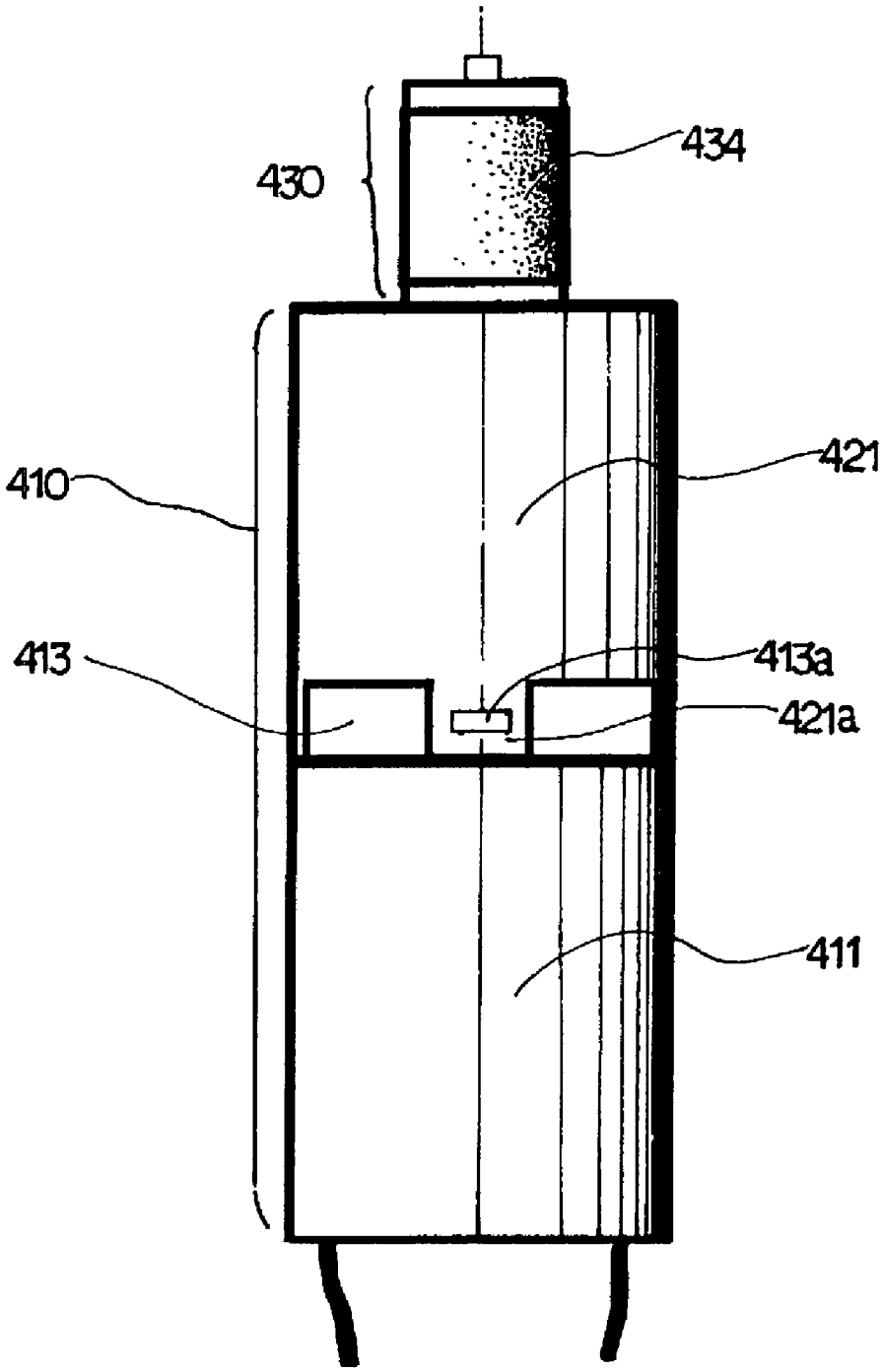
FIG. 11 is a front elevation view of the deceleration module illustrated in FIG. 10.
Figure 12:
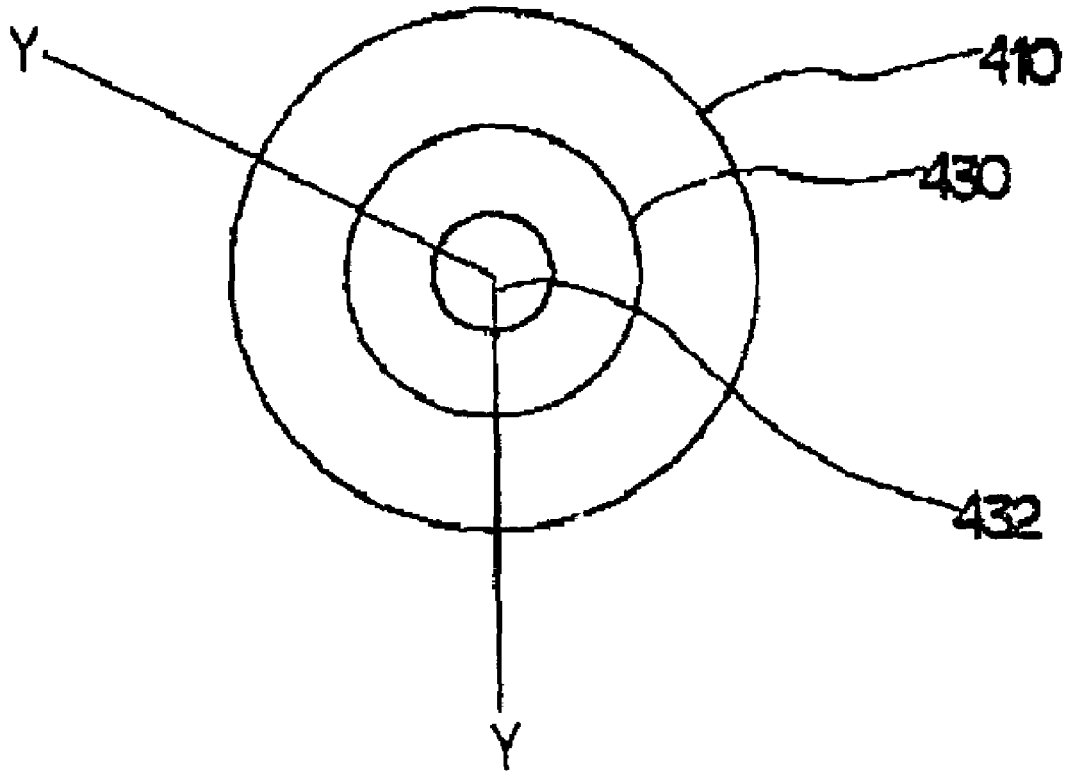
FIG. 12 is a plan view of the deceleration module illustrated in FIG. 10.
Figure 13:
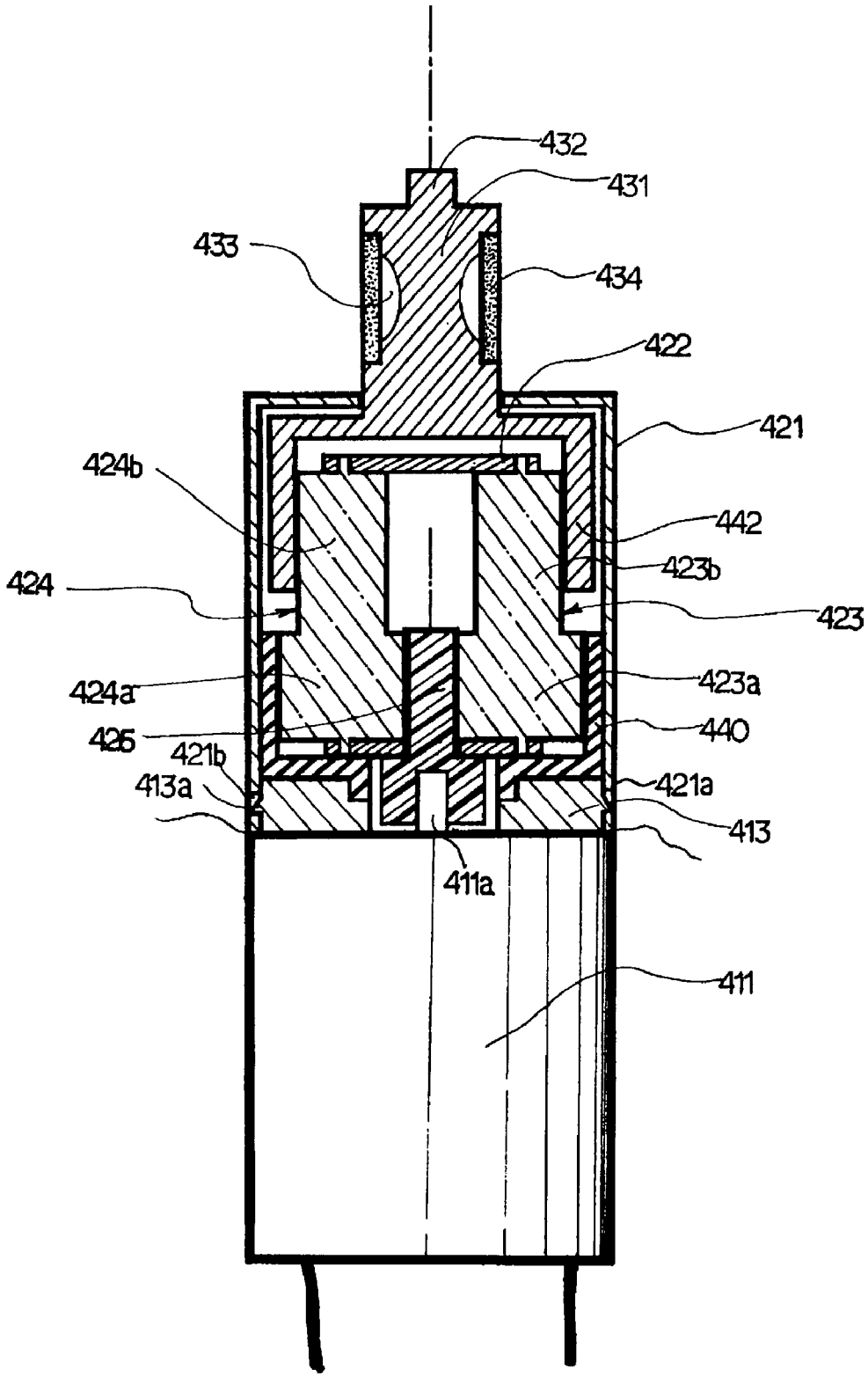
FIG. 13 is a side view of the deceleration module illustrated in FIG. 12, cutaway along line Y—Y shown in FIG. 12.
Figure 14:
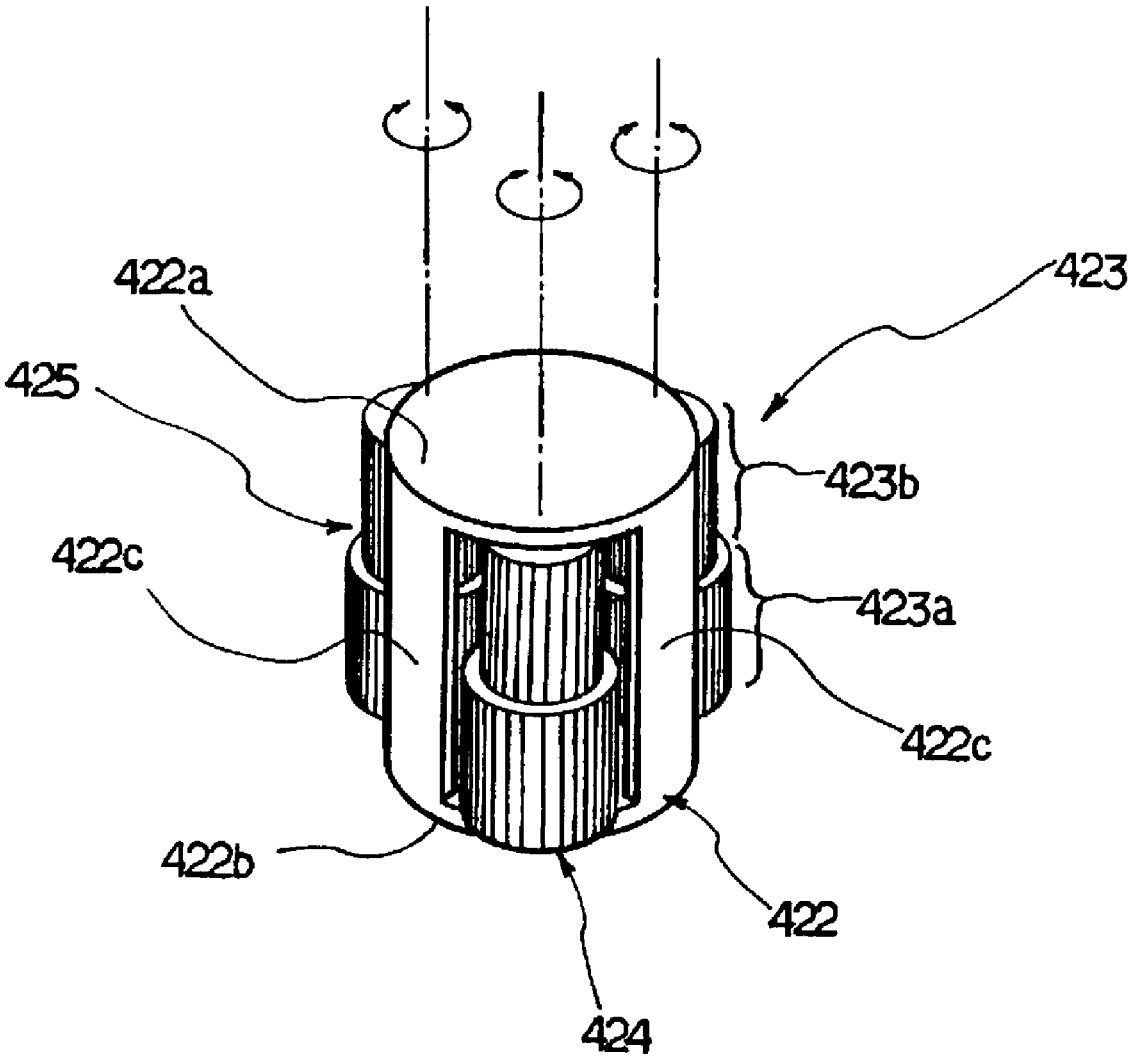
FIG. 14 is a perspective view of a gear box in the deceleration module according to the second embodiment of the present invention.

The operation of the deceleration unit 320 in the deceleration module 30 is described below. As illustrated in FIG. 8, the planetary gears 322, 323 and 324 engage with the center gear 312, which is mounted to the motor unit 310. The planetary gears 322, 323 and 324 are arranged equidistantly with each of their central axes 322*a*, 323*a* and 324*a* positioned at 120° intervals around the center gear 312. The planetary gears 322, 323 and 324 also engage he internal gear 325. The internal gear 325 has teeth formed on its inner circumferential surface. The planetary gears 322, 323 and 324 engage the teeth of the internal gear 325 at predetermined intervals. The rotation of the center gear 312 dictates the rotation of the planetary gears 322, 323 and 324, which in turn dictates the rotation of the internal gear 325. The internal gear 325 has a greater number of teeth than any one of the planetary gears 322, 323 and 324. Each planetary gear has more teeth than the center gear 312. As a result, deceleration occurs.

The center gear 312 rotates in engagement with the planetary gears 322, 323 and 324 leads to a primary deceleration and the rotation of the planetary gears 322, 323 and 324 in engagement with the internal gear 325 leads to a secondary deceleration. An intended primary-secondary deceleration ratio can be obtained by adjusting the number of the teeth of the center gear 312, the planetary gears 322, 323 and 324, or the internal gear 325.

FIGS. 10 to 15 illustrate a deceleration module 410 integrated with a rolling device 430 according to another preferred embodiment of the present invention. Referring to FIGS. 10 to 15, the deceleration module 410 is comprised of a driving motor 411 and a deceleration unit 412 combined with the driving motor 411. The deceleration unit 412 is integrally formed with the rolling device 430. A case 421 holds the deceleration unit 412 and protects the gears of the deceleration unit 412. Here, the case 421 does not contain the rolling device 430. The case 421 has an engagement portion 421*a* and an engagement hole 421*b* by which it can be combined with the driving motor 411.

The driving motor 411 is a rotary type. Its rotating direction and speed are controlled by a controller (not shown). The deceleration unit 412 includes a gear box for receiving rotational force from a rotating shaft 411*a* (shown in FIG. 13) of the driving motor 411, an internal fixed gear 440 in engagement with gears of the gear box, for rotating the gear box, an internal rotating gear 442 for decelerating in engagement with the gears of the gear box, and the rolling device 430 integrally injection-molded with the internal rotating gear 442.

The gear box includes a gear housing 422, a central shaft 426 combined with the rotating shaft 411*a* of the driving motor 411, and three planetary gears 423, 424 and 425 (shown in FIG. 14) that equidistantly engage the central shaft 426. The planetary gear 423 is divided into a first gear portion 423*a* and a second gear portion 423*b* which have different teeth in number. The other planetary gears 424 and 425 are the same in structure as the planetary gear 423.

The rolling device 430 has a roller 431, a rubber surface coating 434 surrounding the outer circumference of the roller 431, and a hinge 432 extended in the rotating axis of the roller 431. The roller 431 is shaped like a spool and thus has a smaller diameter at its middle than at its upper and lower ends.

Preferably, a support member 413 intervenes between the driving motor 411 and the deceleration unit 412. The support member 413 is mounted to the driving motor 411 to secure the internal fixed gear 440, and has a plurality of protrusions 413*a* formed on its outer circumferential surface to each be inserted into a corresponding engagement hole 421*b* of the engagement portion 421*a* in the case 421.

Figure 15:
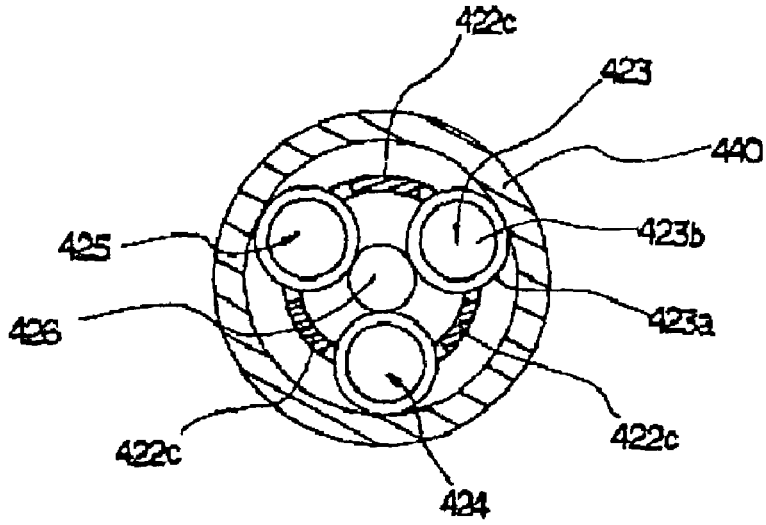
FIG. 15 is a cross sectional view of the gear box illustrated in FIG. 14 showing planetary gears engaging other internal gears.

Referring to FIG. 15, the gear box includes a central shaft 426, the gear housing 422 (not shown), and two or more planetary gears 423, 424 and 425 in engagement with the central shaft 426 within the gear housing 422. The gear housing 422 includes an upper plate 422*a*, a lower plate 422*b*, and three or more connectors 422*c* that connect the upper and lower plates 422*a* and 422*b*. The planetary gears 423, 424 and 425 are partially exposed through openings defined by the connectors 422*c*. The planetary gears 423, 424 and 425 are arranged equidistantly so that their central axes are separated by 120° around the rotating axis of the gear housing 422, for the example shown of three planetary gears.

Planetary gear 423 is described herein as a representative planetary gear because the planetary gears 423, 424 and 424 are the same in structure. The planetary gear 423 includes a first gear portion 423*a* and a second gear portion 423*b* connected to the first gear portion 423*a*. The first gear portion 423*a* has more teeth than the second gear portion 423*b*, to produce a third deceleration.

The first gear portion 423*a* can engage with the internal fixed gear 440 and the second gear portion 423*b* can engage with the internal rotating gear 442. The planetary gear 423 rotates with the first gear portion 423*a* in engagement with the internal fixed gear 440 with the rotating speed of the driving motor 411, bringing about a secondary deceleration. Thus, the gear box decelerates. The planetary gear 423 rotates with the second gear portion 423*b* in engagement with the internal rotating gear 442, thereby bringing about the third deceleration.

In operation, if the driving motor rotates, the rotating shaft 411*a* rotates. Then, the central shaft 426 connected to the rotating shaft 411*a* and then the planetary gears 423, 424 and 425 engage the gear on the central shaft 426, to rotate in the gear box. The difference in number between the teeth of the gear on the central shaft 426 and each planetary gear causes the primary deceleration. Here, each planetary gear has more teeth than the gear on the center shaft 426. At the same time, the gear housing 422 rotates, since the first gear portions of the planetary gears 423, 424 and 425 are in engagement with the internal fixed gear 440. The secondarily decelerated gear box provides the rolling device 430 with a thirdly decelerated rotating force caused by the difference between the difference in teeth between the first and second gear portions. The diameter of each first gear portion 423*a* is greater than that of each second gear portion 423*b*.

The rotating force of the driving motor 411 is provided to the rolling device 430 after three decelerations.

Hereinbelow, installation of the deceleration module in the body housing will be described. Although the reference numerals of the second embodiment are utilized, it will be observed that the following description also applies to the other embodiment.

Figure 16:
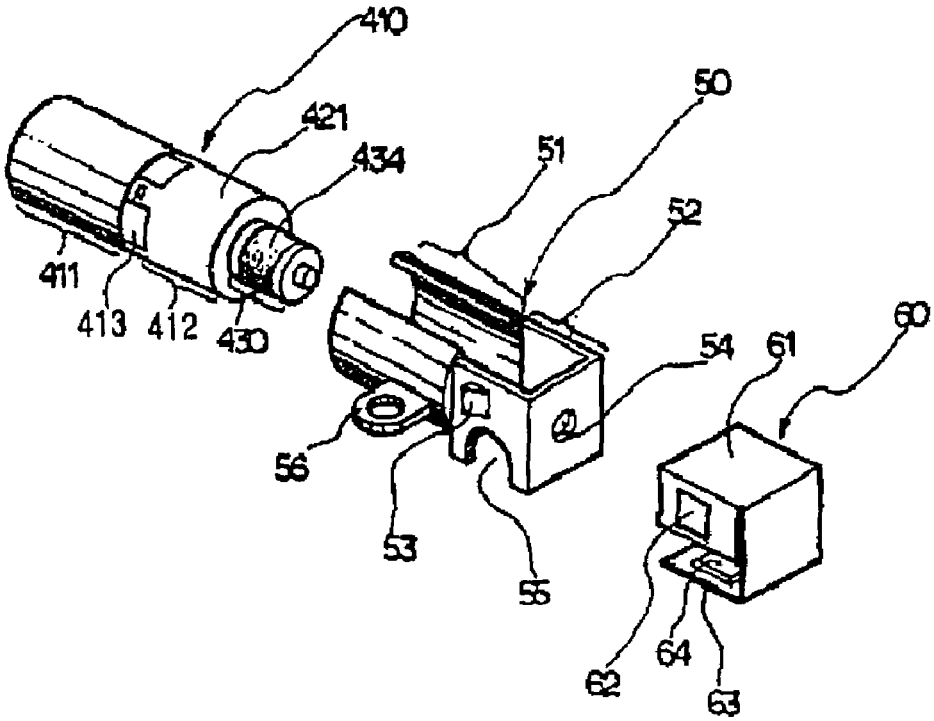
FIG. 16 is an exploded perspective view of a main bracket, an auxiliary bracket and the deceleration module of an embodiment of the present invention.
Figure 17:
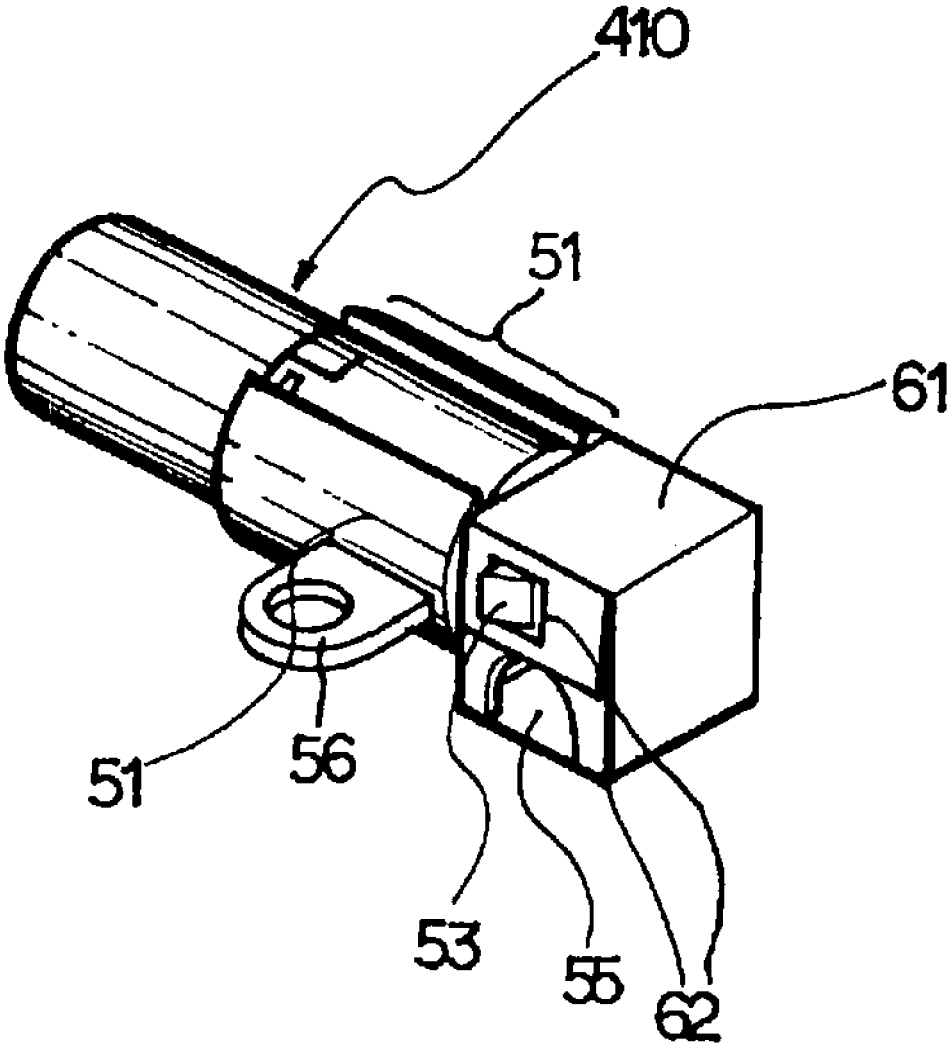
FIG. 17 is a perspective view of the assembled deceleration module shown in FIG. 16.

Referring to FIGS. 16 and 17, the deceleration module 410 is installed in a predetermined position within a body housing using two brackets (i.e., a main bracket 50 and an auxiliary bracket 60), located below an antenna housing. The main bracket 50 accommodates the deceleration unit 412 and the rolling device 430 and the auxiliary bracket 60 accommodates the rolling unit 430 once more. The main bracket 50 is divided into a first portion 51 corresponding to the deceleration unit 412 and a second portion 52 corresponding to the rolling device 430. The first and second portions 51 and 52 are integrally formed of a metal or plastic. Two engagement pieces 56 (only one is illustrated) have engagement holes formed in the first portion 51. The upper end of the second portion 52 is open. The second portion 52 has a hinge hole 54 formed at its rear end and an opening 55 formed at its lower end, for inserting the rod antenna therein. Protrusions of the main bracket 53 are protruded symmetrically from both sides of the second portion 52, to combine with the corresponding engagement holes 62 of the auxiliary bracket 60. When the protrusions of the main bracket 53 are engaged with the engagement holes 62, then the main bracket 50 is combined integrally with the auxiliary bracket 60.

The auxiliary bracket 60 has an upper end closed, engagement holes 62 on its sides, and a protrusion of the auxiliary bracket 64 at its lower end. The protrusion of the auxiliary bracket 64 contacts or slides on the rod antenna. The auxiliary bracket 60 is formed by pressing and bending a metal thin film and thus has resilience in itself.

Figure 18:
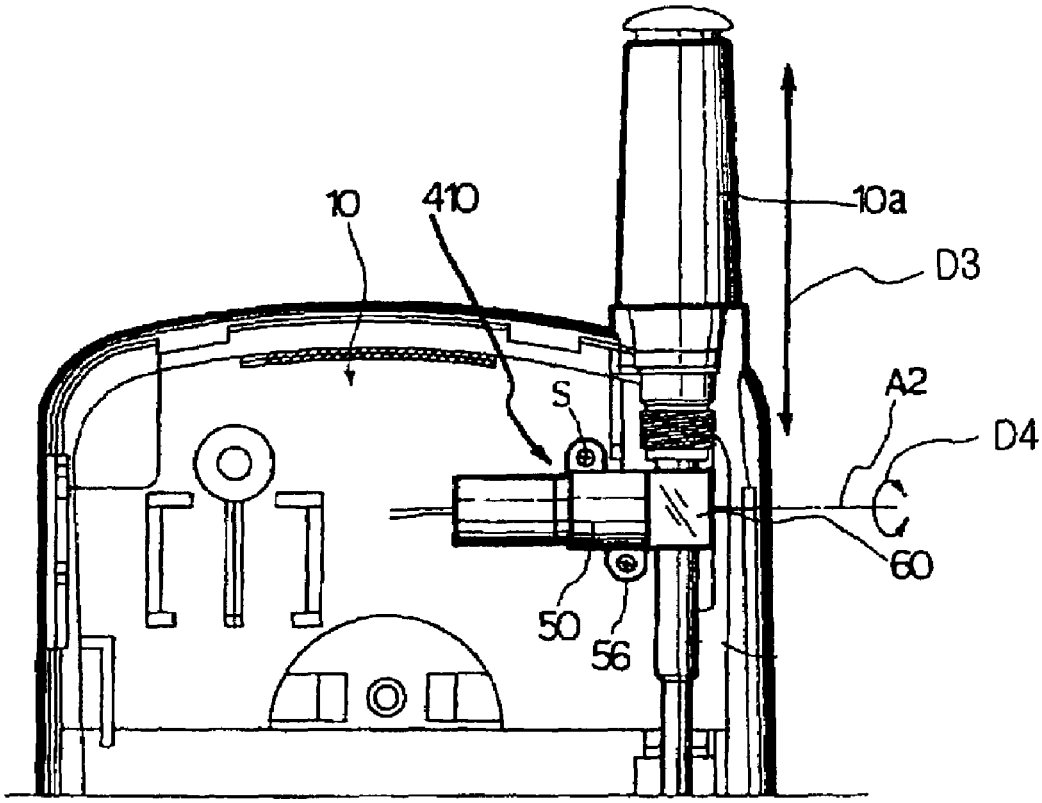
FIG. 18 is an internal plan view of the portable terminal showing the deceleration module according to an embodiment of the present invention contained in a body housing.
Figure 19:
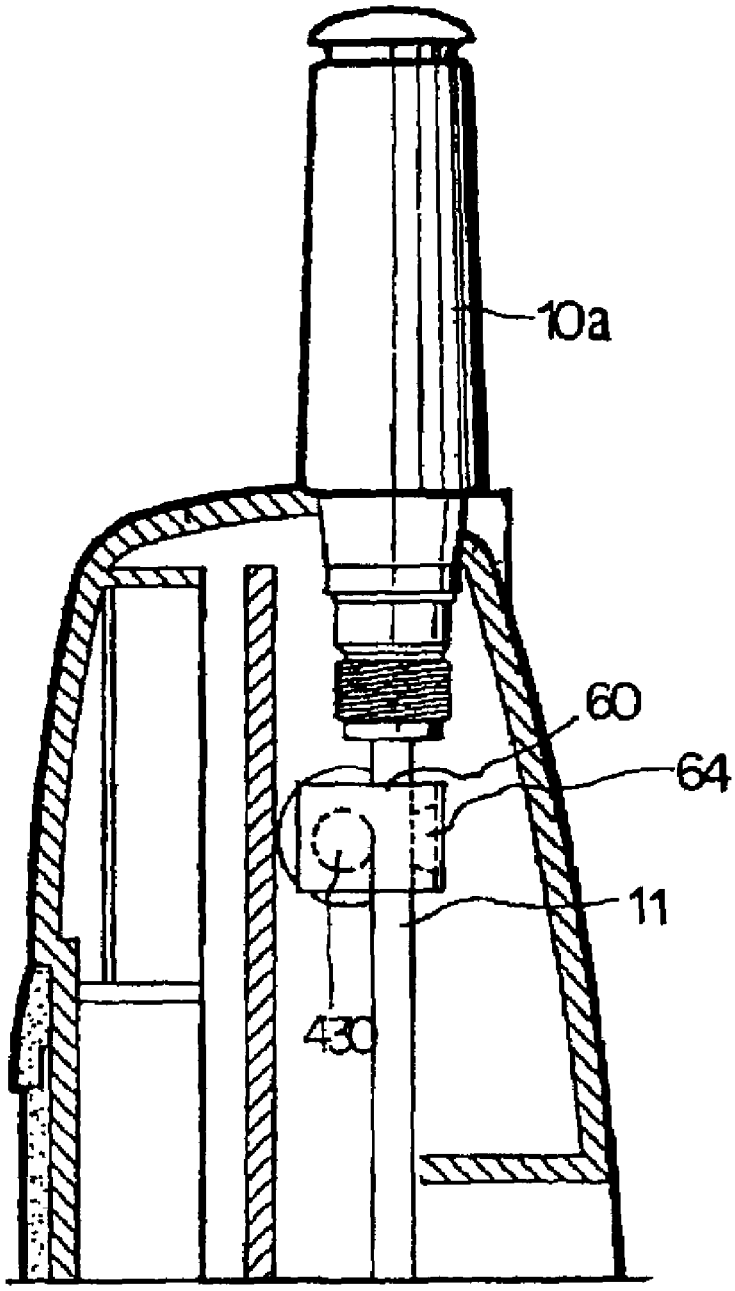
FIG. 19 is an internal side view of the portable terminal showing the deceleration module in the body housing illustrated in FIG. 18.

FIGS. 18 and 19 illustrate the thus-constituted automatic antenna extending system contained in the body housing. The deceleration module is installed in the body housing by tightening screws in the engagement holes and the rod antenna is disposed between the rolling device and the protrusion of the auxiliary bracket in order to move in a direction D3.

In accordance with the present invention, as described above, the motor driver is integral with the rolling device in the deceleration module. Therefore, the overall size of the deceleration module is reduced, which contributes to miniaturization of the body housing. Moreover, the deceleration module requires a reduced number of parts, resulting in the increase of assembly efficiency and throughput and the decrease of manufacture cost.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A deceleration module for extending or retracting a whip antenna, comprising:

motor unit located within a body of a portable terminal;

a deceleration unit for reducing the rotational speed of the motor unit by at least a factor of two; and a roller unit integrally formed with the deceleration unit and contacts an outer circumference of the whip antenna, wherein both the roller unit and deceleration unit are coaxially positioned with respect to each other.

2. The deceleration module of claim 1, wherein the roller unit includes a spool-shaped roller that increases the friction force between the roller and the whip antenna.

3. The deceleration module of claim 1, wherein the roller unit includes a roller having a rubber surface coating.

4. The deceleration module of claim 1, wherein the deceleration unit includes:

a center gear mounted to the motor unit;

a first deceleration gear for primarily reducing a rotating speed provided by the center gear; and a second deceleration gear for secondarily reducing the reduced rotating speed, wherein the second deceleration gear is in engagement with the first deceleration gear.

5. The deceleration module of claim 4, wherein the second deceleration gear is integrally formed with the roller unit.

6. The deceleration module of claim 4, wherein the second deceleration gear surrounds the first deceleration gear.

7. The deceleration module of claim 4, wherein the first deceleration gear includes at least one planetary gear engaging with the center gear along the outer circumference of the center gear.

8. The deceleration module of claim 7, wherein a plurality of planetary gears are arranged equidistantly around the center gear.

9. The deceleration module of claim 4, wherein the second deceleration gear has a plurality of teeth on a inner circumferential surface thereof, and said plurality of teeth engage the first deceleration gear.

10. The deceleration module of claim 1, wherein the deceleration unit is contained in a case.

11. The deceleration module of claim 1, wherein a rotating axis of the roller unit forms substantially a right angle to an extending and retracting direction of the whip antenna.

12. An automatic antenna extending system for automatically extending and retracting a whip antenna, comprising:

a deceleration module located under an antenna housing, including a motor unit, a deceleration unit for decelerating a rotating force provided coaxially from the motor unit by at least a factor of two, and a roller unit integrally formed with the deceleration module and disposed to roll in an extending and retracting direction of the whip antenna in contact with an outer circumference of the whip antenna.

13. The automatic antenna extending system of claim 12, wherein the roller unit includes an auxiliary roller having a rubber surface coating.

14. A deceleration module for automatically extending and retracting a whip antenna, comprising:

a driving motor;

a deceleration unit coaxial with the driving motor, for reducing the rotating speed of the driving motor by at least a factor of two and providing the reduced rotating speed;

a rolling device integrally formed with the deceleration unit and extending from the deceleration unit;

a case for containing the deceleration unit therein; and a support member between the driving motor and the deceleration unit, for securing the case and the deceleration unit.

15. The deceleration module of claim 14, wherein the rolling device includes a roller shaped like a spool and a hinge that is integral with the roller.

16. The deceleration module of claim 14, wherein the rolling device further includes a roller having a rubber surface coating.

17. The deceleration module of claim 14, wherein the deceleration unit includes:

an internal fixed gear secured on the support member;

a gear box having a plurality of planetary gears, for rotating in engagement with the internal fixed gear; and an internal rotating gear engaged with the gear box, for providing rotating force to the rolling device.

18. The deceleration module of claim 17, wherein the gear box includes a gear housing, at least two planetary gears arranged equidistantly with respect to the rotating axes of the planetary gears in a radial direction, and a central shaft fixedly attached to a shaft of the driving motor.

19. The deceleration module of claim 18, wherein three planetary gears are arranged equidistantly around the center shaft.

20. The deceleration module of claim 18, wherein each of the planetary gears is configured to decelerate the rotating speed of the driving motor.

21. The deceleration module of claim 20, wherein each planetary gear has a first gear portion that engages the internal fixed gear, and a second gear portion that engages the internal rotating gear, the first gear portion being of a larger diameter than the second gear portion.

22. The deceleration module of claim 18, wherein the gear housing includes an upper plate, a lower plate, and at least two connectors equidistantly arranged for connecting the upper and lower plates.

23. An automatic antenna extending system for automatically extending a rod antenna in a portable terminal, comprising:

a deceleration module including a driving motor, a deceleration unit integrally secured to the driving motor for reducing the rotating speed of the driving motor, and a rolling device integrally formed with the deceleration unit;

a main bracket installed in a predetermined position in a body housing, wherein the main bracket includes a first portion for surrounding the deceleration unit and a second portion, extending from the first portion, for surrounding the rolling device; and an auxiliary bracket engaged with the main bracket, for surrounding the second portion of the main bracket.

24. The automatic antenna extending system of claim 23, wherein the main bracket further includes an opening at a lower end thereof, for extending and retracting the rod antenna.

25. The automatic antenna extending system of claim 23, wherein the main bracket further includes an engagement protrusion that combines with an engagement hole of the auxiliary bracket.

26. The automatic antenna extending system of claim 23, wherein the auxiliary bracket further includes a protrusion at a lower end thereof for contacting and riding on the rod antenna.

27. The automatic antenna extending system of claim 23, wherein the main bracket is formed of a metal.

28. The automatic antenna extending system of claim 23, wherein the auxiliary bracket is formed of a metal film.

* * * * *